US007882767B2

(12) United States Patent
Musemeche

(10) Patent No.: US 7,882,767 B2
(45) Date of Patent: Feb. 8, 2011

(54) DUMBELL ROLLER ASSEMBLY FOR TONG UNIT

(75) Inventor: Clint Musemeche, Youngsville, LA (US)

(73) Assignee: Mech-Tech Engineering, LLC, Broussard, LA (US)

( * ) Notice: Subject to any disclaimer, the term of this patent is extended or adjusted under 35 U.S.C. 154(b) by 96 days.

(21) Appl. No.: 12/433,024

(22) Filed: Apr. 30, 2009

(65) Prior Publication Data

US 2009/0272232 A1 Nov. 5, 2009

Related U.S. Application Data

(60) Provisional application No. 61/049,611, filed on May 1, 2008.

(51) Int. Cl.
*B25B 13/50* (2006.01)
*B25B 17/00* (2006.01)

(52) U.S. Cl. ..... 81/57.15; 81/57.33

(58) Field of Classification Search ..... 81/57.15, 81/57.16, 57.18, 57.33, 57.34
See application file for complete search history.

(56) References Cited

U.S. PATENT DOCUMENTS 5,144,868 A * 9/1992 Feigel, Jr. ..... 81/57.15
6,386,284 B1 * 5/2002 Buck et al. ..... 166/77.53
6,446,524 B1 * 9/2002 Gravouia ..... 74/459.5

* cited by examiner

*Primary Examiner*—David B Thomas
(74) *Attorney, Agent, or Firm*—Law Office of Jesse D. Lambert, L.L.C.

(57) ABSTRACT

A power tong having a ring gear and dumbell rollers, with mating load surfaces on the ring gear and dumbell rollers which transfer horizontal and vertical loads from the ring gear to the dumbell rollers, without contact between the ring gear teeth and the dumbell rollers. The power tong further has a dumbell roller shaft configuration which permits vertical and rotational locking of the shaft, while permitting easy replacement and without binding of the rotation of the top and bottom plates on the dumbell rollers.

5 Claims, 3 Drawing Sheets

DUMBELL ROLLER ASSEMBLY FOR TONG UNIT

CROSS REFERENCE TO RELATED APPLICATIONS

This regular patent application claims priority to U.S. Provisional Patent Application Ser. No. 61/049,611, filed May 1, 2008, for all purposes.

BACKGROUND

1. Field of the Invention

This invention relates to apparatus used to screw together (or "make up") and unscrew (or "break out") threaded tubular connections joining sections (frequently called "joints") of tubulars. Such tubulars are frequently used in the drilling, servicing and completion of oil and gas wells, in the form of drill pipe, tubing, and other similar tubular goods. Such apparatus are commonly referred to as "tong units" or "power tongs," which use toothed dies carried by tong jaws, to transmit torque to the tubular connection. It is to be understood that the term tong unit, for purposes of this application, encompasses both the power tong portion of the tong unit (that is, the part that turns one side of the tubular connection) and the backup portion of the tong unit (that is, the part which holds the other side of the tubular connection).

In more detail, this invention relates to a tong unit which comprises dumbell rollers and a ring gear having mating, circumferential load support surfaces, both vertical (i.e. substantially parallel to the rotational axis of the ring gear of the tong), and angled or inclined to the ring gear rotational axis; and a dumbell roller shaft mounting system, as more particularly described herein.

2. Related Art

By way of background, a typical tong unit will be described in sufficient detail to enable those having ordinary skill in the relevant art field to understand how the present invention is incorporated therein.

Tong Units Generally

With reference to FIG. 1, a tong body 10 carries a gear system, generally referred to as 20, which is driven by a motive source, typically a hydraulic motor 30. As is well known in the art, rotation of the motor turns the gears, which turn ring gear 40; as can be readily appreciated, ring gear 40 thereby has a rotational axis (for clarity, denoted as RA in FIG. 2), about which ring gear 40 rotates. The rotary movement of ring gear 40, and thereby torque, is transmitted from ring gear 40 to a jaw assembly referred to in globo as 50, thence to dies 60 carried in the jaw assembly, and ultimately to a tubular connection 70 (shown in cross section), by the dies pressing against and/or biting into the metal of the connection. As is known in the art, the jaws are held within the ring gear by cage plates both above and below the ring gear, not shown in FIG. 1 for clarity.

Although the present invention has applicability to both closed- and open-throat tongs, by way of illustration an open throat tong will be used in the description of the invention. The ring gear in an open throat tong has a cut-out, as can be seen in the drawing, to permit the tubular to be moved into and out of the gripping region of the tong. Said another way, the ring gear in an open throat tong does not form a complete circle, but has a section cut out of the circle.

Prior Art Ring Gear Support

The ring gear in a power tong must be supported both vertically and horizontally by the tong body, transferred through intervening structural elements, including the dumbell rollers described herein. The primary vertical load generated by the ring gear is its weight. The primary horizontal load generated by the ring gear arises out of "spreading" (that is, the tendency of the open throat of the ring gear to open further) of the ring gear as it comes under load. Both the vertical load and the horizontal load must ultimately be transferred to the tong body.

Both the vertical and horizontal loads are primarily transferred from the ring gear to a plurality of so-called "dumbell rollers," named for their shape, as can be readily seen in FIGS. 2 and 3 (element 100; see also FIG. 4 for the general shape of a dumbell roller). Prior art dumbell rollers and ring gears both had square (or nearly square) shoulders forming the vertical support for the ring gear (namely, forming a horizontal support surface, to take vertical loads); the bottom horizontal surface of the ring gear teeth (i.e. the "sides" of the teeth) contacted the horizontal surface of the dumbell roller, providing the required vertical force. As can be readily understood, that arrangement tended to wear the ring gear teeth and dumbell rollers.

In addition, prior art dumbell roller arrangements comprised a dumbell roller retainer arrangement which could result in binding of the roller, under one set of conditions; or excessive wear between various parts, under other conditions.

DESCRIPTION OF THE PRESENTLY PREFERRED EMBODIMENT(S)

Figure 1:
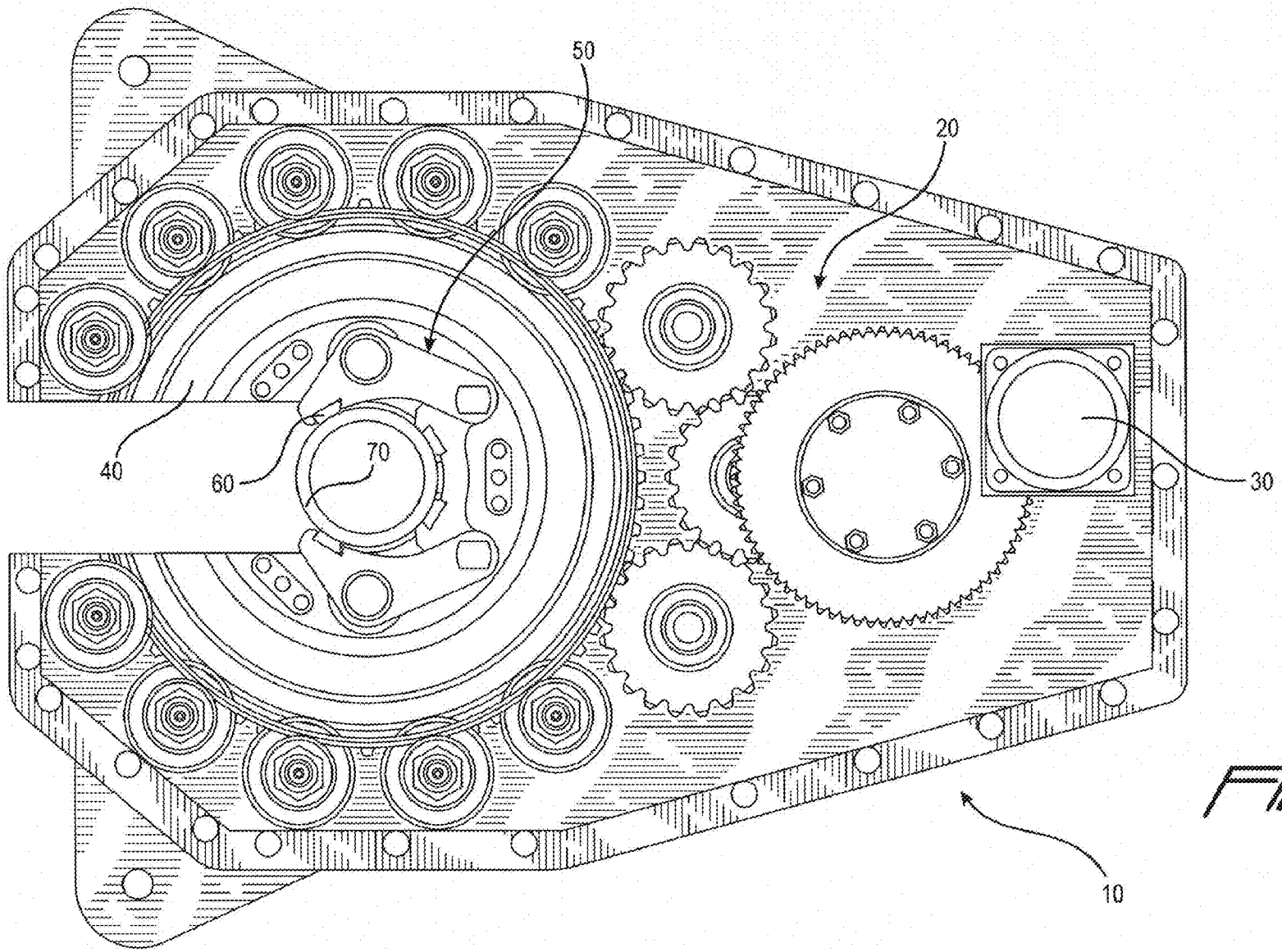
FIG. 1 is a top view of a representative tong unit, showing generally the placement of various components thereof.

The Load Support Surfaces of the Present Invention

As earlier described, horizontal loads generated by ring gear 40 arise in part due to the tendency of the open throat of the ring gear to spread under load, thereby tending to increase the outer diameter of ring gear 40 (i.e. move it horizontally outward from a center point). Ring gear 40 has a first set of spaced apart upper and lower circumferential load support surfaces, readily seen in FIG. 3 as elements 46, which are substantially parallel to the rotational axis of ring gear 40. As such, in the figures, this first set of spaced apart upper and lower circumferential load support surfaces 46 are substantially vertical. Similarly, dumbell roller 100 has a first set of spaced apart upper and lower circumferential load support surfaces, readily seen in FIG. 3 as elements 104, which engage corresponding surfaces 46 on ring gear 40. Referring again to FIGS. 2 and 3, it can be readily seen that at least part of the horizontal forces from ring gear 40 are transferred to dumbell roller 100 by contact between load support surfaces 46 of ring gear 40, and load support surfaces 104 of dumbell roller 100 (it being understood that such horizontal forces are also transferred in part by contact between the angled or inclined load support surfaces 110 and 42 of the dumbell roller and the ring gear, described below). Further, dumbell roller 100 and ring gear 40 are sized so that the outermost surface of the teeth of ring gear 40 do not contact the central portion of dumbell roller 100. A space, designated as "B" in FIG. 3, exists between the outermost surface 43 of the teeth 44 of ring gear 40, and the central portion 111 of dumbell roller 100.

Figure 2:
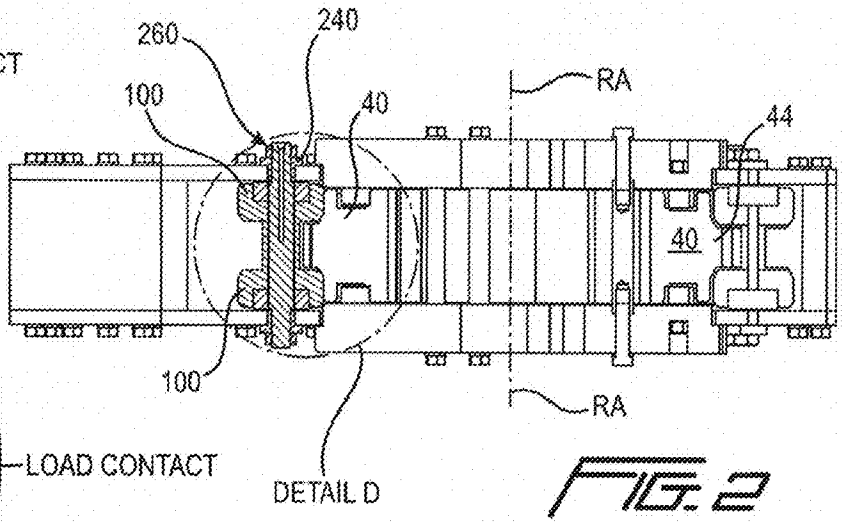
FIG. 2 is a partial cross section view of a portion of a power tong, showing the dumbell roller and ring gear of the present invention.

Both ring gear 40 and dumbell rollers 100 also comprise a second set of load support surfaces, now described. As can be seen in FIG. 2, and with further detail in FIG. 3, the present invention comprises a tong unit with dumbell rollers having both vertical and angled (or inclined to vertical) load support surfaces, and a ring gear having mating vertical and angled (or inclined to vertical) load support surfaces.

Dumbell roller 100 comprises a second set of spaced apart upper and lower circumferential load support surfaces 110 on both the top and bottom sections. This second set of upper and lower circumferential load support surfaces 110, as can be seen in the figures, are angled, in the sense that they lie at an angle inclined to the axis of rotation of ring gear 40. As is shown in FIG. 2, and in further detail in FIG. 3, ring gear 40 (shown in cross section) also has a second set of spaced apart upper and lower circumferential load support surfaces 42, having mating angles to the corresponding surfaces on the dumbell roller (110). Further, dumbell roller 100 and ring gear 40 are sized so that the vertical load of the ring gear (i.e. its weight) is fully supported on the mating angled load support surfaces (the weight of ring gear 40 being transferred to dumbell roller 100 through mating surfaces 42 and 110), while the teeth 44 of ring gear 40 are spaced, vertically, away from the upper and lower horizontal shoulder surfaces 102 of dumbell roller 100. This can be readily seen in FIG. 3, where a gap or space "A" is shown between the ring gear teeth side surfaces and the dumbell roller horizontal shoulder surface 102. It is understood, as mentioned previously, that the second set of load support surfaces carries both vertical and horizontal loads.

This attribute of the present invention prevents undesirable wear to the bottom surface of the ring gear teeth and to the corresponding load bearing surface of the dumbell rollers, caused by the ring gear teeth "riding on" the dumbell roller horizontal shoulder surface 102, as in prior art designs.

Prior Art Dumbell Roller Shaft Support System

Figure 4:
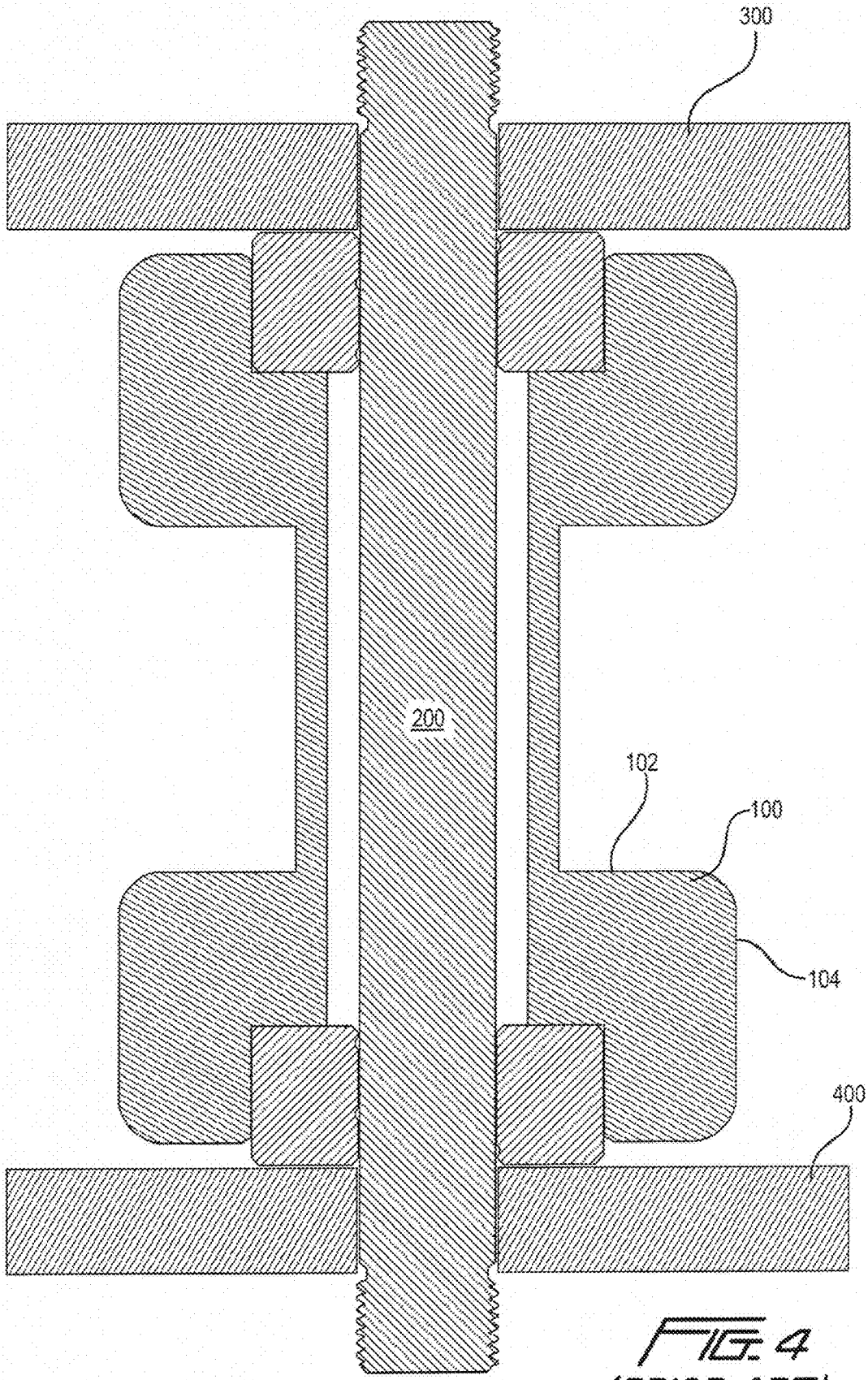
FIG. 4 (PRIOR ART)
FIG. 4 is a representative cross section of a prior art dumbell shaft arrangement.

From time to time, dumbell rollers must be removed from a tong for repair or replacement. In prior art designs, the dumbell rollers rotated on a shaft having a uniform diameter. The shaft was threaded on both ends, and ran through the top and bottom plates of the tong body and lengthwise through the dumbell roller. A nut was screwed onto both ends of the shaft to hold it in place. An exemplary prior art configuration is shown in FIG. 4 (where, to the extent possible, like elements have like element numbers). It can be appreciated that nuts on either end of shaft 200 would bear against upper and lower plates 300 and 400.

This prior art design has several limitations. In practice, while the vertical spacing between the top and bottom tong body plates was generally maintained by the mid-portion of the tong body (to which the plates were attached), if the shaft nuts were over-tightened, the plates could flex enough for the dumbell roller to contact the two plates (that is, there would be no clearance between the ends of the dumbell roller and the plates). Obviously, if the shaft nuts were tightened too much, the dumbell roller/plate contact could bind the dumbell roller and prevent it from rotating.

On the other hand, if the shaft nuts were not tightened enough, the friction between the shaft and the inner bore of the dumbell roller could be enough to cause the shaft to rotate, which could result in wear on the plate holes through which the shaft ran. In time, enough wear could occur to create a very loose fit, requiring repair/replacement of the plates.

The Dumbell Roller Shaft Support System of the Present Invention

Figure 3:
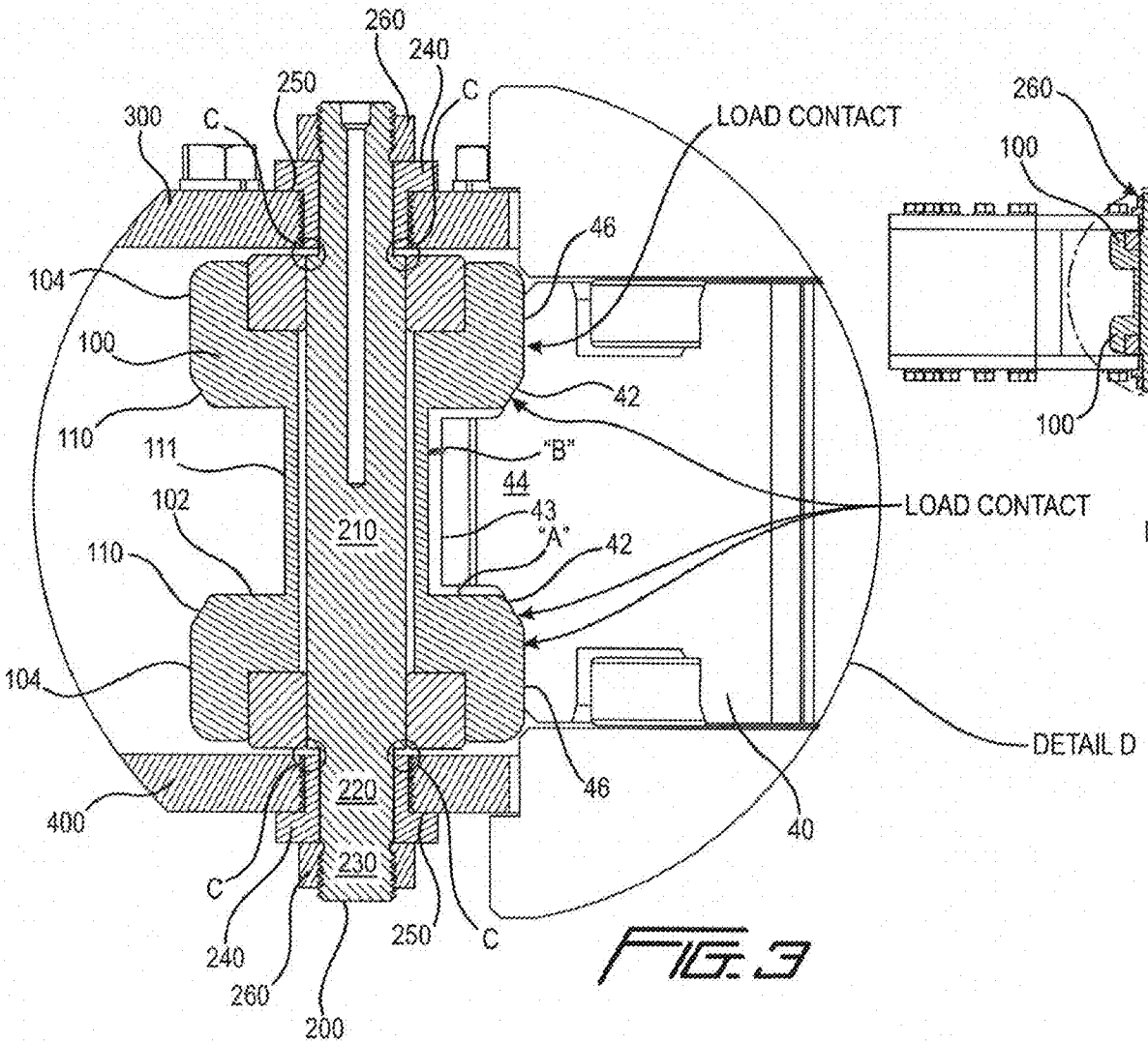
FIG. 3 is a more detailed cross section view of Detail D (noted in FIG. 2), of the dumbell roller, ring gear shoulder area, and dumbell roller shaft support system.

Referring to FIGS. 2 and 3, the present invention further comprises a dumbell roller shaft 200 having a central section 210 with a diameter, reduced diameter sections 220 on either side of central section 210, and preferably threaded sections 230 on each end. It is to be understood that only one of reduced diameter sections 220 and threaded sections 230 are specifically noted in FIG. 3; the corresponding sections at the other end of shaft 200 can be readily seen and understood. As can be seen in FIG. 3, with dumbell roller 100 in place between the top and bottom plates (300 and 400 respectively, the top and bottom plates having aligned holes therein for placement of shafts through the holes), shaft 200 is inserted through one of the plates, through dumbell roller 100 (which has a longitudinal bore therethrough), and through the other plate. The diameter of central section 210 is no larger than the diameter of the holes in top and bottom plates 300 and 400, so that the shaft can pass through the holes. Caps or keeper members 240, which have a central bore sized to snugly accommodate reduced diameter section 220 of shaft 200, and a shoulder 250 which abuts upper plate 300 or lower plate 400 (as the case may be), are engaged into the holes in top and bottom plates 300 and 400, preferably by threaded engagement. Once in place, keeper members 240 maintain shaft 200 from any longitudinal movement (by contact between respective shoulders on keeper members 240 and shaft 200, as indicated at "C"), and also serve to space top and bottom plates 300 and 400 apart and prevent binding of the plates on the dumbell roller. In a preferred embodiment, a means for preventing rotation of shaft 200 is attached thereto, by way of example nuts 260 made up on threaded sections 230 on either end of shaft 200, which serve to prevent keeper members 240 from backing out of their threaded engagement with the top and bottom plates, and also serve to keep shaft 200 from rotating. Rotation of shaft 200 relative to the keeper members 240 is undesirable, since such rotation tends to wear out the bore of the keeper members and/or the shaft.

Once in place, the dumbell roller shaft support system keeps shaft 200 vertically and rotationally locked in place, and capable of serving as a spacer for the top and bottom plates, without the possibility of binding dumbell roller 100 therebetween.

When desired, shaft 200 is easily removed by removing nuts 260 from either end; removing keeper members 240; and sliding shaft 200 out. Dumbell roller 100 can then be moved out of its position, and removed from the tong for repair, replacement, etc.

Materials

As is well known in the relevant art, the various elements of the present invention may be made of metals of types typically used in the fabrication of power tongs and power tong components.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof. For example, dimensions and materials can be changed to suit different applications. The present invention has applicability to various types of power tongs, both open and closed throat.

Therefore, the scope of the invention is to be determined not by the illustrative examples set forth above, but by the appended claims and their legal equivalents.

I claim:

1. A power tong, comprising:

a) a ring gear comprising gear teeth and having a rotational axis, and further comprising a set of spaced apart upper and lower circumferential load support surfaces, disposed inclined to said rotational axis;

b) a plurality of dumbell rollers, each of said plurality of dumbell rollers having a rotational axis and comprising a set of spaced apart upper and lower circumferential load support surfaces, disposed inclined to said rotational axis;

and wherein:

said ring gear and said dumbell rollers are sized and positioned so that said spaced apart circumferential load support surfaces, disposed inclined to said rotational axis, on said ring gear and said plurality of dumbell rollers, are in operational contact, so that vertical and horizontal loads on said ring gear are transferred to said dumbell rollers, and said teeth of said ring gear do not contact said dumbell rollers.

2. A power tong comprising:

a) a main tong body comprising spaced apart upper and lower body plates, said upper and lower body plates having aligned holes therein for mounting of shafts therebetween;

b) a plurality of dumbell rollers disposed between said upper and lower body plates, each of said dumbell rollers having a longitudinal bore therethrough;

c) a plurality of shafts disposed in said bores of said dumbell rollers, upon which said dumbell rollers rotate, each of said shafts having a central section with a first diameter no larger than a diameter of said holes in said upper and lower plates, and reduced diameter sections on either side of said central section, each of said plurality of shafts also disposed through a pair of said aligned holes in said upper and lower plates;

d) a means for preventing rotation of each of said shafts; and e) a keeper member disposed in each of the holes in said upper and lower plates, and having a bore therethrough in which said reduced diameter sections of said shafts are disposed.

3. The power tong of claim 2, wherein said means for preventing rotation of each of said shafts comprises a threaded section proximal each end, and nuts threadably engaged on said threaded sections of said shafts.

4. A power tong, comprising:

a) a main tong body comprising spaced apart upper and lower body plates, said upper and lower body plates having aligned holes therein for mounting of shafts therebetween;

b) a plurality of dumbell rollers disposed between said upper and lower body plates, each of said dumbell rollers having a longitudinal bore therethrough and a rotational axis and comprising a set of spaced apart upper and lower circumferential load support surfaces, disposed inclined to said rotational axis;

c) a plurality of shafts disposed in said bores of said dumbell rollers, upon which said dumbell rollers rotate, each of said shafts having a central section with a first diameter no larger than a diameter of said holes in said upper and lower plates, and reduced diameter sections on either side of said central section, each of said plurality of shafts also disposed through a pair of said aligned holes in said upper and lower plates;

d) a keeper member disposed in each of the holes in said upper and lower plates, and having a bore therethrough in which said reduced diameter sections of said shafts are disposed;

e) a ring gear disposed between said upper and lower body plates and comprising gear teeth and having a rotational axis, and further comprising a second set of spaced apart upper and lower circumferential load support surfaces, disposed inclined to said rotational axis;

and wherein:

said ring gear and said dumbell rollers are sized and positioned so that said spaced apart circumferential load support surfaces, inclined to said rotational axis, on said ring gear and said plurality of dumbell rollers, are in operational contact, so that vertical and horizontal loads on said ring gear are transferred to said dumbell rollers, and said teeth of said ring gear do not contact said dumbell rollers.

5. The tong of claim 4, wherein each of said shafts further comprises a threaded section proximal each end, and nuts threadably engaged on said threaded ends of said shafts.

* * * * *